US009465329B2

(12) United States Patent
Okazaki et al.

(10) Patent No.: US 9,465,329 B2
(45) Date of Patent: Oct. 11, 2016

(54) CLEANING UNIT AND IMAGE FORMING APPARATUS PROVIDED WITH THE SAME

(71) Applicant: Brother Kogyo Kabushiki Kaisha, Nagoya-shi, Aichi-ken (JP)

(72) Inventors: Yoshiyuki Okazaki, Nagoya (JP); Junichi Hashimoto, Toyohashi (JP); Ryuya Yamazaki, Nagoya (JP); Takamasa Tsukada, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/837,106

(22) Filed: Aug. 27, 2015

(65) Prior Publication Data

US 2016/0091828 A1 Mar. 31, 2016

(30) Foreign Application Priority Data

Sep. 30, 2014 (JP) ..... 2014-201748
Sep. 30, 2014 (JP) ..... 2014-201761
Sep. 30, 2014 (JP) ..... 2014-201767
Sep. 30, 2014 (JP) ..... 2014-201772

(51) Int. Cl.
*G03G 15/16* (2006.01)

(52) U.S. Cl.
CPC ..... *G03G 15/1665* (2013.01); *G03G 15/161* (2013.01); *G03G 15/166* (2013.01); *G03G 2215/1661* (2013.01)

(58) Field of Classification Search
CPC ..... G03G 15/161; G03G 15/166; G03G 15/168; G03G 21/105; G03G 2215/1661
USPC ..... 399/101, 358, 360
See application file for complete search history.

(56) References Cited

U.S. PATENT DOCUMENTS 7,107,002 B2 * 9/2006 Saito ..... G03G 21/12 399/360
7,937,036 B2 * 5/2011 Tanaka ..... G03G 21/105 399/358
9,069,322 B2 * 6/2015 Mori ..... G03G 15/0131
2007/0147903 A1 * 6/2007 Mori ..... G03G 15/161 399/264
2009/0067856 A1 * 3/2009 Ito ..... G03G 21/105 399/34
2009/0116853 A1 * 5/2009 Okazaki ..... G03G 21/12 399/12
2009/0220257 A1 9/2009 Tsusaka et al.
2009/0263147 A1 * 10/2009 Kumagai ..... G03G 21/12 399/35
2010/0247119 A1 9/2010 Kawahara
2011/0274457 A1 * 11/2011 Makino ..... G03G 15/161 399/90
2013/0223873 A1 * 8/2013 Manabe ..... G03G 15/0844 399/102
2014/0010579 A1 * 1/2014 Yoshino ..... G03G 21/105 399/358
2014/0044465 A1 * 2/2014 Mekada ..... G03G 21/12 399/358

FOREIGN PATENT DOCUMENTS

JP H10-133534 A 5/1998
JP 2001-066894 A 3/2001
JP 2002-006574 A 1/2002
JP 2004125955 A * 4/2004
JP 2009-210650 A 9/2009
JP 2009-210651 A 9/2009
JP 2010-237422 A 10/2010
JP 2010-237434 A 10/2010

* cited by examiner

*Primary Examiner* — Robert Beatty
(74) *Attorney, Agent, or Firm* — Banner & Witcoff, Ltd.

(57) ABSTRACT

A cleaning unit includes a first accommodating chamber, a first conveyer, a cleaner, and a developing agent conveyer. The accommodating chamber is configured to accommodate therein developing agent. The accommodating chamber has one end portion and another end portion. The first conveyer is configured to convey the developing agent from the one end portion toward the another end portion. The cleaner is configured to collect developing agent from a belt in contact with a photosensitive member. The developing agent conveyer has a collection opening through which developing agent collected from a component other than the belt. The developing agent conveyer is configured to convey the developing agent from the collection opening toward the first accommodating chamber. The cleaner and the developing agent conveyer are positioned at the one end portion.

18 Claims, 8 Drawing Sheets

CLEANING UNIT AND IMAGE FORMING APPARATUS PROVIDED WITH THE SAME

CROSS REFERENCE TO RELATED APPLICATION

This application claims priority from Japanese Patent Application Nos. 2014-201748, 2014-201761, 2014-201767, and 2014-201772 those filed Sep. 30, 2014. The entire content of the priority applications is incorporated herein by reference.

TECHNICAL FIELD

The present disclosure relates to a cleaning unit provided with a toner accommodating portion, and an image forming apparatus provided with the cleaning unit.

BACKGROUND

Japanese Patent Application Publication No. Hei 10-133534 discloses an image forming apparatus provided with an accommodating portion for accommodating toner collected from a photosensitive member. The toner accommodating portion or a waste toner aggregating container is positioned at one end portion of an intermediate transfer drum. A toner conveying portion is connected to the waste toner container and is positioned at the end portion of the drum at which the container is also provided. The waste toner aggregating container is configured to receive toner falling down from the toner conveying portion.

SUMMARY

Generally, a belt cleaning unit includes a waste toner containing portion extending from one end portion toward another end portion of a belt in widthwise direction thereof. Assuming that the belt cleaning unit is provided to the image forming apparatus of the disclosed Japanese Patent Application Publication No. Hei 10-133534. In the latter case, the toner conveying portion should be provided to the waste toner containing portion. As a result, waste toner may be accumulated only at one end portion of the waste toner containing portion, and thus, a remaining space in the waste toner containing portion, i.e., other than the one end portion cannot be effectively utilized for toner accumulation.

It is therefore an object of the present disclosure to provide a cleaning unit and an image forming apparatus provided with the same capable of effectively utilizing an internal space of the waste toner containing portion.

It is therefore an object of the disclosure to provide a cleaning unit including a first accommodating chamber, a conveyer, and a conveyer. The first accommodating chamber is configured to accommodate therein developing agent. The first accommodating chamber has one end portion and another end portion. The first conveyer is configured to convey the developing agent from the one end portion toward the another end portion. The first conveyer is positioned in the first accommodating chamber. The cleaner is configured to collect developing agent from a belt in contact with a photosensitive member. The first developing agent conveyer is configured to convey the developing agent from a collection opening toward the first accommodating chamber. The collection opening is configured to collect therethrough the developing agent collected from a component other than the belt. The cleaner and the first developing agent conveyer are positioned at the one end portion.

According to another aspect, an image forming apparatus includes a photosensitive member, a belt, a cleaning unit. The photosensitive member is configured to carry a developing agent image thereon. The belt is in contact with the photosensitive member. The cleaning unit includes a first accommodating chamber, a first conveyer, a cleaner, and a first developing agent conveyer. The first accommodating chamber is configured to accommodate therein developing agent. The first accommodating chamber has one end portion and another end portion. The first conveyer is configured to convey the developing agent from the one end portion toward the another end portion. The cleaner is configured to collect developing agent from the belt. The first developing agent conveyer is configured to convey the developing agent from the collection opening toward the first accommodating chamber. The collection opening is configured to collect therethrough the developing agent collected from the photosensitive member. The cleaner and the first developing agent conveyer are positioned at the one end portion.

BRIEF DESCRIPTION OF THE DRAWINGS

The particular features and advantages of the disclosure will become apparent from the following description taken in connection with the accompanying drawings, in which.

DETAILED DESCRIPTION

A color laser printer 1 according to a first embodiment will be described while referring to FIGS. 1 through 6D.

Directions in the following description will be based on an orientation of the color laser printer 1 shown in FIG. 1. Specifically, the left side of the printer 1 in FIG. 1 will be called the "front," the right side will be called the "rear," the near side will be called the "right," and the far side will be called the "left." Further, the "top" and "bottom" of the printer 1 will correspond to the vertical direction in FIG. 1.

Figure 1:
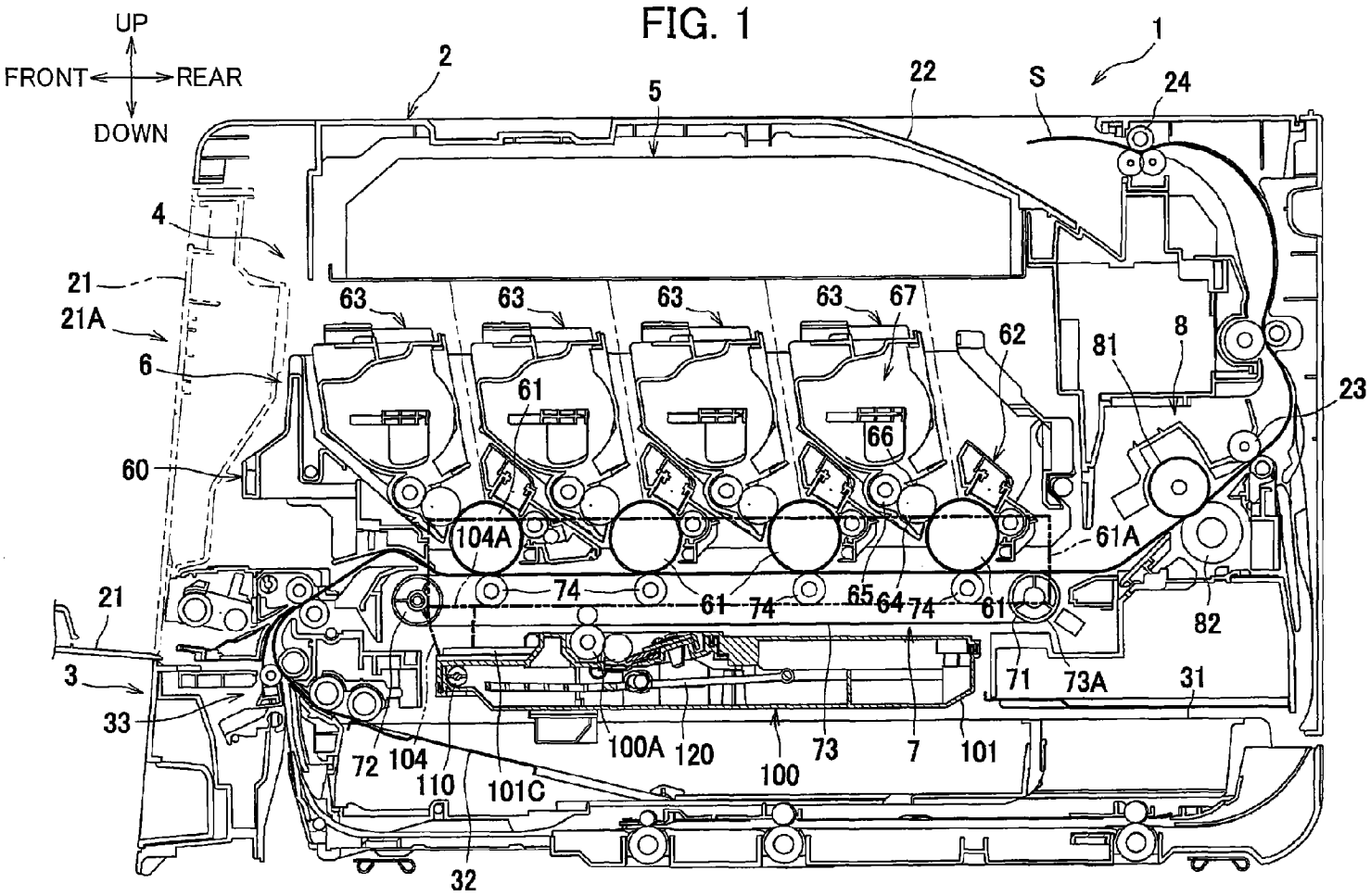
FIG. 1 is a schematic view showing a general construction of a color laser printer provided with a cleaning unit according to a first embodiment.

As shown in FIG. 1, the color laser printer 1 includes a main casing 2. Within the main casing 2, primarily provided are a sheet-feeding section 3 for supplying sheets P of paper to be printed, an image-forming section 4 for forming images on the sheets P supplied by the sheet-feeding section 3. The image forming section 4 includes an exposure unit 5, a process unit 6, a transfer unit 7, and a fixing unit 8.

The sheet-feeding section 3 is provided in a bottom portion of the main casing 2. The sheet-feeding section 3 primarily includes a sheet tray 31, a sheet-feeding mechanism 33, and a lifter plate 32. A leading end portion of the sheet S accommodated in the sheet tray 31 is urged upward by the lifter plate 32, and the sheet-feeding mechanism 33 is configured to separate the sheets P in the sheet tray 31 and supply the separated sheet S one at a time to the image-forming section 4.

The exposure unit 5 is provided in an upper portion of the main casing 2. Although not shown in the drawings, the exposure unit 5 includes a plurality of laser light-emitting units, a polygon mirror, lenses, reflecting mirrors, and the like.

The process unit 6 is arranged between the sheet tray 31 and the exposure unit 5, and primarily includes a drawer 60, a plurality of (four) photosensitive drums 61 as examples of photosensitive member arrayed in frontward/rearward direction, a plurality of chargers 62, and a plurality of developing cartridges 63. Each charger 62 and each developing cartridge 63 are provided for each photosensitive drum 61. Each developing cartridge 63 has a cartridge frame in which a toner accommodating chamber 67 is defined. Further, the developing cartridge 63 includes a developing roller 64, a supply roller 65, and a toner layer thickness regulation blade 66.

The drawer 60 is configured to retain the four photosensitive drums 61, and is movable in frontward/rearward direction relative to the main casing 2. The main casing 2 has a front portion formed with an opening 21A which is covered by a front cover 21. The drawer 60 can be pulled out of the main casing 2 through the opening 21A by opening the front cover 21.

The transfer unit 7 is provided between the sheet tray 31 and the process unit 6, and can be mounted in and removed from the main housing 10. The transfer unit 7 primarily includes a drive roller 71, a follower roller 72, a conveying belt 73 as an example of a belt looped over the drive roller 71 and the follower roller 72 in a taut state, and four transfer rollers 74.

The conveying belt 73 has an outer surface 73A that has a top portion in contact with each photosensitive drum 61. The transfer rollers 74 are arranged on the inside of the loop formed by the conveying belt 73 at positions for pinching the conveying belt 73 against corresponding photosensitive drums 61.

A cleaning unit 100 is provided beneath the transfer unit 7 for cleaning the conveying belt 73, i.e., for removing waste toner as an example of developing agent from the surface of the conveying belt 73. The cleaning unit 100 is an example of a cleaner.

Figure 2:
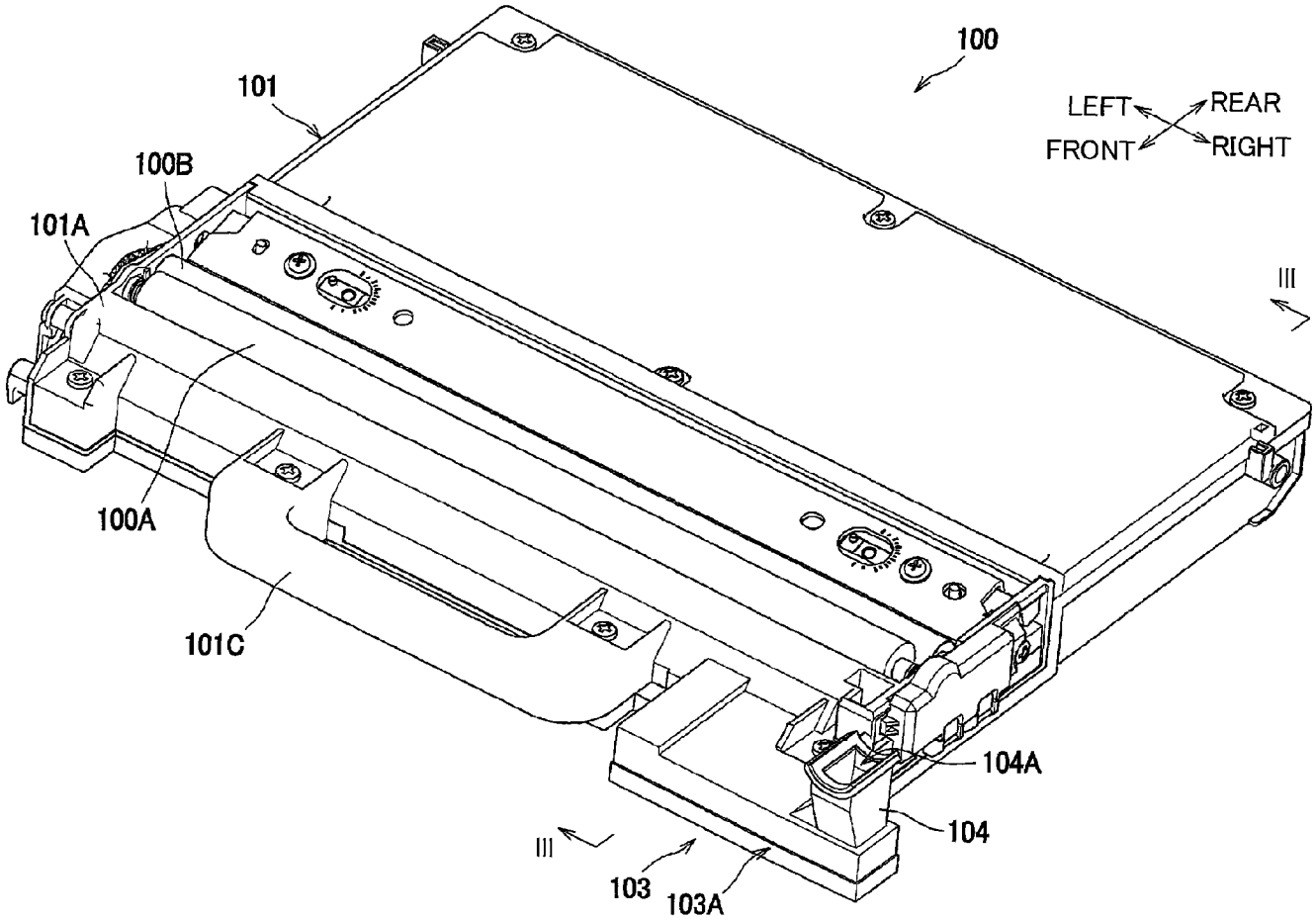
FIG. 2 is a perspective view of the cleaning unit according to the embodiment.
Figure 3:
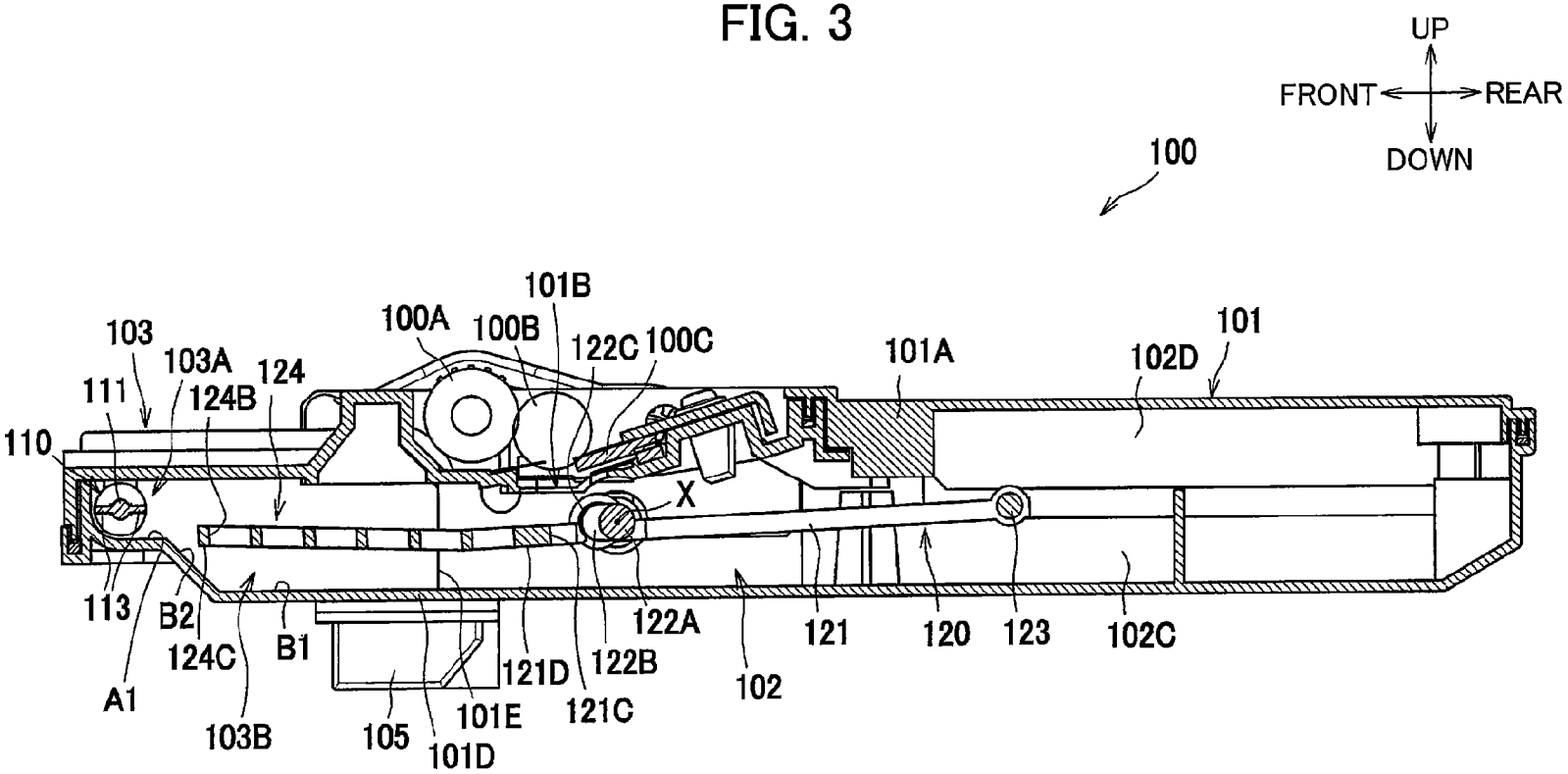
FIG. 3 is a cross-sectional view taken along a line III-III in FIG. 2.

As shown in FIGS. 2 and 3, the cleaning unit 100 includes a frame 101 having a top wall 101A, a cleaning roller 100A, a recovery roller 100B, and a blade 100C. The cleaning roller 100A is provided at a front portion of the top wall 101A.

The cleaning roller 100A is so positioned that a top surface of the cleaning roller 100A is in contact with a bottom surface of the conveying belt 73 for collecting waste toner remaining on the conveying belt 73. The recovery roller 100B is so positioned that a front surface of the recovery roller 100B is in contact with a rear surface of the cleaning roller 100A for collecting waste toner on the cleaning roller 100A. As shown in FIG. 3, the blade 100C is positioned rearward of the recovery roller 100B and extends diagonally upward and rearward such that a front edge of the blade 100C is positioned lower than a rear edge thereof. The front edge of the blade 100C is in contact with the rear surface of the recovery roller 100B for scraping off the waste toner from the recovery roller 100B.

The top wall 101A of the frame 101 is formed with an opening 101B at a position facing the contacting position between the recovery roller 100B and the blade 100C. Thus, the waste toner scraped by the blade 100C can be introduced into a toner accommodating section 102 as an example of a first accommodating chamber, described later, through the opening 101B.

As shown in FIG. 1, the fixing unit 8 is disposed rearward of the process unit 6 and transfer unit 7. The fixing unit 8 includes a heat roller 81, and a pressure roller 82 disposed in confrontation and contacting with the heat roller 81 with pressure.

In the image-forming section 4, the charger 62 applies a uniform charge to the surface of the photosensitive drum 61, after which the exposure unit 5 irradiates laser beams (indicated by dotted chain lines in FIG. 1) in a high-speed scan to expose the surfaces of corresponding photosensitive drums 61 to light and form electrostatic latent images thereon on a basis of image data. The supply rollers 65 supply toner from the corresponding toner accommodating chambers 67 to the corresponding developing rollers 64, and the toner on the surfaces of the developing rollers 64 is maintained at a uniform thickness by the corresponding thickness-regulation blades 66.

The toner carried on the surfaces of the developing rollers 64 is then supplied to the electrostatic latent images formed on the corresponding photosensitive drums 61 to produce visible toner images on the photosensitive drums 61. Thereafter, a sheet S supplied onto the conveying belt 73 is conveyed between the photosensitive drums 61 and the transfer rollers 74, whereby the toner images formed on the photosensitive drums 61 are respectively transferred to and superposed on the sheet S.

After the toner image has been transferred onto the sheet S, the sheet S is conveyed between the heat roller 81 and pressure roller 82 to thermally fix the toner image to the sheet S. The sheet S is then discharged outside the main housing onto a discharge tray 22 through a conveyer roller 23 and a discharge roller 24.

Next, the cleaning unit 100 will be described in detail. As shown in FIG. 2, the cleaning unit 100 has a handle 101C. The handle 101C has a general U-shape in a plan view and is disposed on the front edge of the frame 101 in the approximate left-right center thereof. As shown in FIG. 1, the cleaning unit 100 can be mounted in or removed from the main casing 2 through the access opening 21A formed in the front side of the main casing 2 after the process unit 6 and transfer unit 7 have been removed. That is, the access opening 21A through which the cleaning unit 100 is mounted and removed is formed in the main casing 2 on the side nearest the handle 101C when the cleaning unit 100 is mounted in the main casing 2.

Figure 4:
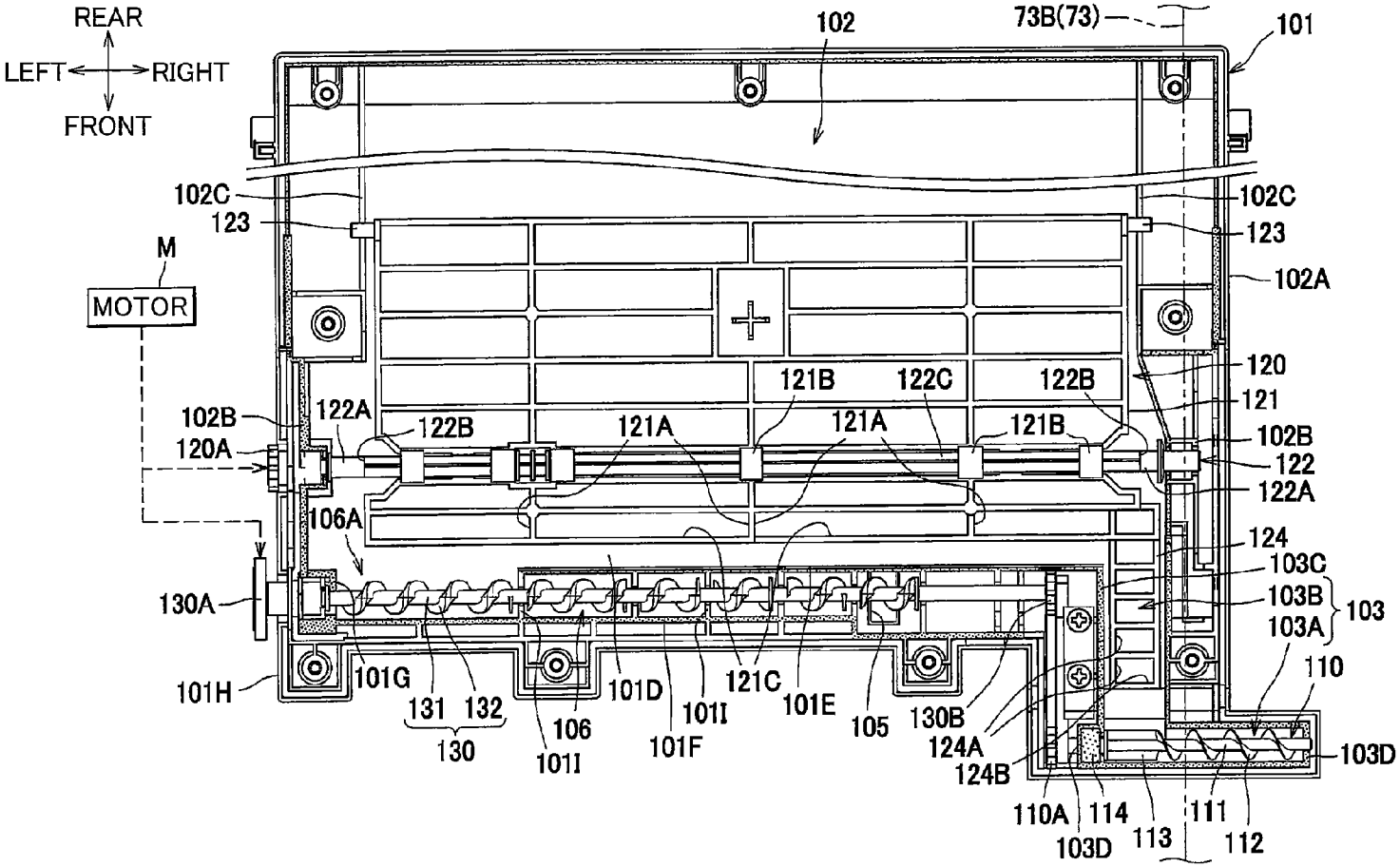
FIG. 4 is a plan view of the cleaning unit in which an upper wall of a frame of the cleaning unit is removed.

As shown in FIGS. 1, 3, and 4, the frame 101 is configured of an accommodating section 102, a first toner conveying portion 103 as an example of a first developing agent conveyer, a guiding section 104, a detecting section 105 as an example of a second accommodating chamber, and a second toner conveyer 106 as an example of a second developing agent conveyer. To rephrase that, the accommodating section 102, first toner conveying portion 103, guiding section 104, detecting section 105, and second toner conveying portion 106 are formed by the walls constituting the frame 101. For convenience, the portions of walls forming the accommodating section 102, first toner conveying portion 103, guiding section 104, detecting section 105, and second toner conveying portion 106 in FIG. 4 have been depicted with dots that are formed more densely than the dots depicting a sealing member 114 described later.

In addition to the cleaning roller 100A, recovery roller 100B, and blade 100C, a first conveying member 120 as an example of a first conveyer, a second conveying member 110 as an example of a second conveyer, and an auger 130 are provided in the frame 101.

As shown in FIGS. 3 and 4, the accommodating section 102 extends from the rear end of the frame 101 to a front-rear position corresponding to the cleaning roller 100A. The accommodating section 102 serves to accommodate waste toner. That is, the accommodating section 102 extends from a partitioning wall 101E (described later) of the frame 101, which is positioned forward of the cleaning roller 100A, to the rear wall of the frame 101.

The first toner conveying portion 103 is connected to the accommodating section 102 on the forward side of the cleaning roller 100A. The first toner conveying portion 103 includes a first conveying section 103A, and a second conveying section 103B as an example of a carrying section.

As shown in FIG. 4, the first conveying section 103A is formed further forward than the cleaning roller 100A and extends in the left-right direction. The right end of the first conveying section 103A protrudes further rightward than the right side surface 102A in a front view. The right side surface 102A forms the right end of the accommodating section 102. That is, the right end of the first conveying section 103A has a portion protruding outside of a right side surface 102A on the frame 101. Specifically, the first conveying section 103A extends leftward from outside to inside of a right edge 73B of the conveying belt 73 in the left-right direction.

The second conveying section 103B is connected to the left end of the first conveying section 103A. More specifically, the second conveying section 103B extends rearward from the left end portion of the first conveying section 103A and connects to the front side on the right end of the accommodating section 102. The left-right dimension of the second conveying section 103B is shorter than the left-right dimension of the accommodating section 102.

As shown in FIG. 3, the inner surface on a bottom portion B1 of the second conveying section 103B is positioned lower than the inner surface on a bottom portion A1 of the first conveying section 103A. The inner surface on the bottom portion B1 is connected to the inner surface on the bottom portion A1 by the inner surface on a connecting part B2.

The connecting part B2 slopes downward from the rear edge of the bottom portion A1 that constitutes the first conveying section 103A toward the front edge of the bottom portion B1 that constitutes the second conveying section 103B.

Figure 5A:
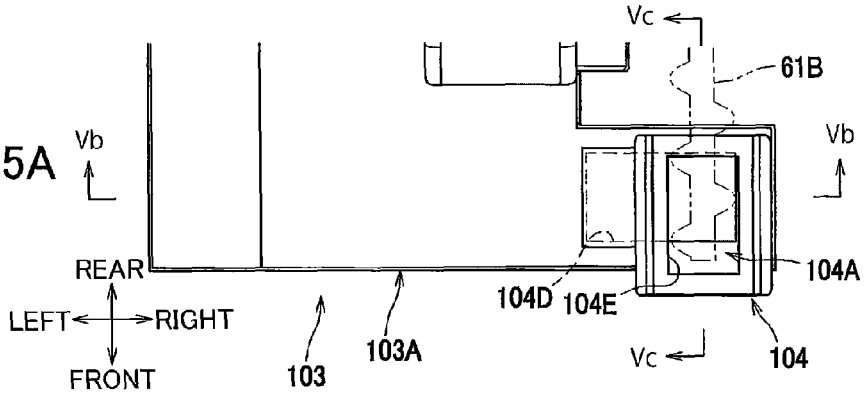
FIG. 5A is an enlarged plan view particularly showing a first toner conveying portion of the cleaning unit according to the embodiment.
Figure 5B:
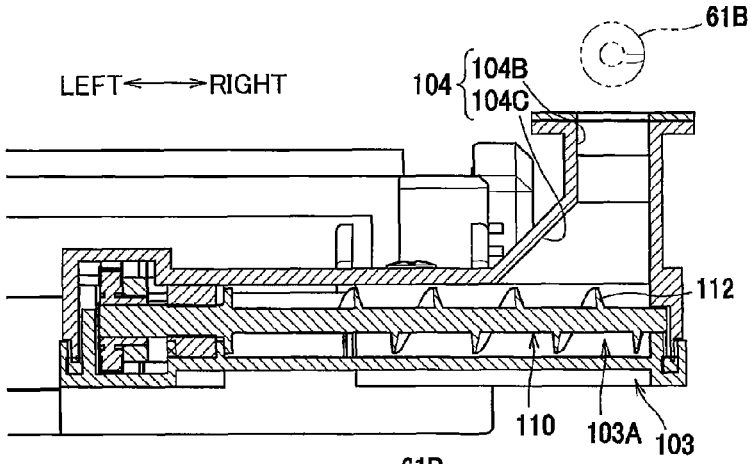
FIG. 5B is a cross-sectional view taken along a line Vb-Vb in FIG. 5A.

As shown in FIGS. 5A and 5B, the guiding section 104 extends upward from the right end of the first conveying section 103A. A collection opening 104A is formed in the top end of the guiding section 104 for collecting waste toner. As shown in FIG. 1, the collection opening 104A is positioned higher than the cleaning roller 100A and lower than the outer surface 73A on the upper portion of the conveying belt 73, i.e., the extended surface on the side of the conveying belt 73 that contacts the photosensitive drums 61.

A photosensitive-drum toner conveying section 61A is provided above the guiding section 104. The photosensitive-drum toner conveying section 61A collects waste toner scraped off the photosensitive drums 61 by cleaning blades (not shown) provided on the rear sides of the respective photosensitive drums 61 and conveys this waste toner toward the collection opening 104A. The photosensitive-drum toner conveying section 61A extends in the front-rear direction covering the range in which the photosensitive drums 61 are disposed. The front end of the photosensitive-drum toner conveying section 61A is connected to the top end of the guiding section 104, i.e., to the collection opening 104A. As shown in FIG. 5A, an auger 61B is disposed inside the photosensitive-drum toner conveying section 61A.

The auger 61B extends in the front-rear direction and functions to convey waste toner collected from the photosensitive drums 61 in a forward direction toward the collection opening 104A.

As shown in FIG. 5B, the guiding section 104 has an upper part 104B, and a lower part 104C. The upper part 104B has a substantially fixed width in the left-right direction. The lower part 104C expands in the left-right direction, i.e., the direction in which the first conveying section 103A is elongated, from the upper part 104B downward.

Figure 5C:
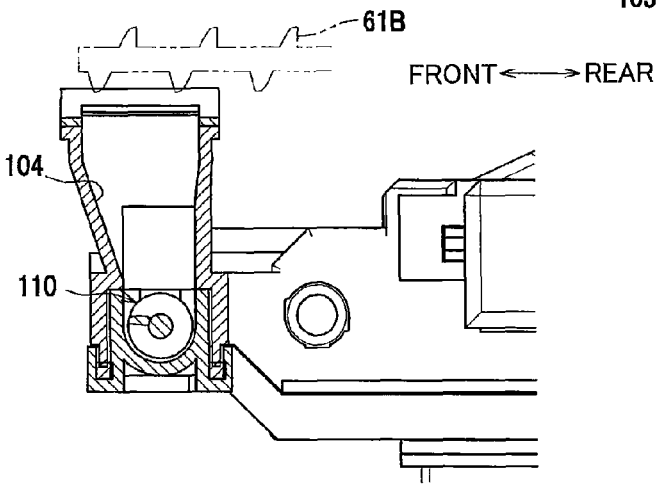
FIG. 5C is a cross-sectional view taken along a line Vc-Vc in FIG. 5A.

As shown in FIG. 5C, the guiding section 104 extends upward while expanding in the front-rear direction, which is the direction of movement of the outer surface 73A on the upper portion of the conveying belt 73 that contacts the photosensitive drums 61. In other words, both the upper part 104B and lower part 104C described above expand in the front-rear direction from bottom to top, and the upper part 104B has a larger front-rear dimension than the lower part 104C. This configuration enables the collection opening 104A to be made wider in the front-rear direction so that the collection opening 104A can more easily collect waste toner conveyed by the auger 61B.

As shown in FIG. 5A, horizontal cross sections of the guiding section 104 taken at the top and bottom ends thereof are rectangular in shape. However, the longitudinal dimension of the rectangular cross section at the bottom end of the guiding section 104 extends in a different direction from the longitudinal dimension of the rectangular cross section at the top end of the guiding section 104. That is, the rectangular cross section at the bottom end of the guiding section 104 has a first side 104D corresponding to the longitudinal dimension, while the rectangular cross section at the top end of the guiding section 104 has a second side 104E corresponding to the longitudinal dimension. The first side 104D extends in the left-right direction, and the second side 104E extends in the front-rear direction.

As shown in FIG. 4, the detecting section 105 is disposed on the frontward of the accommodating section 102 and to the left of the second conveying section 103B at a position partitioned from the accommodating section 102 by the partitioning wall 101E. The partitioning wall 101E is an example of the wall protruding upward from a bottom wall 101D of the frame 101 and connecting to the top wall 101A.

The detecting section 105 is also partitioned from the second conveying section 103B by a left wall 103C of the second conveying section 103B and by a plurality of walls arranged to the left of the left wall 103C. Here, the left wall 103C and the plurality of walls arranged to the left of the left wall 103C are examples of walls partitioning the second conveying section 103B.

As shown in FIG. 3, the detecting section 105 is formed as a recess extending downward from the bottom wall 101D of the frame 101. That is, the detecting section 105 is a convex protrusion on the bottom of the bottom wall 101D. The detecting section 105 functions to accommodate a portion of the waste toner. The detecting section 105 includes a transparent member allowing the passage of light from a photosensor (not shown). Waste toner that flows into the detecting section 105 from the accommodating section 102 blocks light emitted from the photosensor, enabling the photosensor to detect when the accommodating section 102 is full.

As shown in FIG. 4, the partitioning wall 101E extends from the rear edge of the left wall 103C, which constitutes the second conveying section 103B, to a position leftward of the detecting section 105. A gap is formed between the left end of the partitioning wall 101E and a left wall 101G of the frame 101. The region from the left wall 101G to the left of the detecting section 105 and between the partitioning wall 101E and a front wall 101F of the frame 101 constitutes the second toner conveying portion 106.

A toner sealing wall 101I is provided between and connected to the partitioning wall 101E and front wall 101F. The toner sealing wall 101I has a recess that follows the circumferential surface of a rotational shaft 131 of the auger 130 described later. A gap is formed between the top wall 101A and the rotational shaft 131 disposed within this recess of the toner sealing wall 101I, allowing waste toner to move into the second toner conveying portion 106.

The second toner conveying portion 106 has a communication part 106A between the left end of the partitioning wall 101E and left wall 101G that communicates with the accommodating section 102. Waste toner overflowing in the accommodating section 102 can flow into the second toner conveying portion 106 through the communication part 106A.

The second conveying member 110 is disposed in the first conveying section 103A. The second conveying member 110 includes a rotational shaft 111, a first conveying blade 112, and second conveying blades 113.

The rotational shaft 111 is oriented in the left-right direction and is supported in left and right side walls 103D of the first conveying section 103A.

The first conveying blade 112 is wound in a spiral shape around the circumference of the rotational shaft 111 from the right end of the first conveying section 103A toward the left end.

The second conveying blades 113 have a plate shape that is elongated in the left-right direction and that extends radially outward from the rotational shaft 111. Two of the second conveying blades 113 are provided on opposing circumferential sides of the rotational shaft 111. The second conveying blades 113 are arranged in a position corresponding to the second conveying section 103B in the left-right direction and connect to the left edge of the first conveying blade 112, i.e., the inner left-right edge of the first conveying blade 112.

Since the first conveying blade 112 and second conveying blades 113 form an uninterrupted connection, the waste toner conveyed by the first conveying blade 112 can be smoothly transferred to the second conveying blades 113, and waste toner conveyed by the first conveying blade 112 is less likely to spill between the first conveying blade 112 and second conveying blades 113 than a configuration in which the first conveying blade 112 is not connected to the second conveying blades 113.

Here, the position corresponding to the second conveying section 103B is the position forward of the second conveying section 103B that is aligned with the first conveying section 103A, i.e., the position at which the second conveying section 103B and first conveying section 103A intersect. More specifically, the position corresponding to the second conveying section 103B is the position on the left end of the first conveying section 103A that connects to the front end of the second conveying section 103B and is within the left-right dimension of the second conveying section 103B.

When rotated, the second conveying member 110 having this configuration can convey waste toner carried by the first conveying blade 112 from right to left, and specifically from the outside to the inside of the right edge 73B constituting the conveying belt 73. The second conveying blade 113 of the second conveying member 110 can then push the waste toner rearward, i.e., toward the second conveying section 103B positioned radially outside the rotational shaft 111.

A sealing member 114 is provided on the left side wall 103D of the second conveying member 110. The sealing member 114 is formed of a sponge or other resilient member. The sealing member 114 is provided around the circumference of the rotational shaft 111 between the second conveying blade 113 and the left side wall 103D. The sealing member 114 restrains waste toner conveyed into the first conveying section 103A from leaking between the left side wall 103D and rotational shaft 111.

The first conveying member 120 includes a body part 121, a crankshaft 122, support parts 123, and an extension part 124. The body part 121, support parts 123, and extension part 124 are integrally formed. The extension part 124 is an example of a transporting member.

The body part 121 is a lattice-shaped member forming a plurality of rectangular holes 121A that penetrate the body part 121 vertically. Of the surfaces that form the holes 121A of the body part 121, the surfaces facing rearward constitute first conveying surfaces 121C that function to convey waste toner rearward.

The body part 121 integrally has a plurality of supported parts 121B that are rotatably supported on the crankshaft 122. The supported parts 121B are arranged at intervals in the left-right direction in a region in the front-rear direction forward of the front-rear center of the body part 121.

The crankshaft 122 extends in the left-right direction, with its left and right ends supported in left and right side walls 102B of the accommodating section 102. A first gear 120A is coupled to the left end of the crankshaft 122 on the outside of the left side wall 102B. A drive force is transmitted from a motor M to the first gear 120A.

As shown in FIGS. 3 and 4, the crankshaft 122 includes rotational shaft parts 122A, arm parts 122B, and a support part 122C. The rotational shaft parts 122A rotate about their central axis X. The rotational shaft parts 122A are provided on respective left and right ends of the crankshaft 122.

As shown in FIG. 3, the arm parts 122B extend radially outward from the inner edges of the left and right rotational shaft parts 122A.

As shown in FIGS. 3 and 4, the support part 122C is a shaft part that extends parallel to the rotational shaft parts 122A and rotatably supports the supported parts 121B of the body part 121. Specifically, the supported parts 121B are mounted over the support part 122C. The left and right arm parts 122B are arrayed parallel to each other. The support part 122C connects the end portions of the left and right arm parts 122B and revolves around the central axis X of the rotational shaft parts 122A as the rotational shaft parts 122A rotate.

The support parts 123 are provided on the rear end of the body part 121 and protrude outward from the body part 121 in respective left and right directions. As shown in FIG. 3, the accommodating section 102 is further provided with first walls 102C that protrude upward from the bottom wall 101D to a position corresponding to the support parts 123, and second walls 102D that protrude downward from the top wall 101A to a position corresponding to the support parts 123.

Thus, the first walls 102C and second walls 102D are respectively positioned below and above the support parts 123 and function to receive the support parts 123 therebetween. The support parts 123 can slide in the front-rear direction between the corresponding first walls 102C and second walls 102D.

As shown in FIGS. 3 and 4, the extension part 124 extends inside the first toner conveying portion 103, and specifically along the inner surfaces of the second conveying section 103B, from the front side of the body part 121. The extension part 124 has a plurality of rectangular holes 124A formed therein. The holes 124A are juxtaposed in the front-rear direction and penetrate the extension part 124 vertically. Of the surfaces that define the holes 124A, the surfaces facing rearward constitute second conveying surfaces 124B that function to convey waste toner rearward.

The second conveying surfaces 124B of the extension part 124 can convey a larger amount of waste toner than the amount of waste toner conveyed by the second conveying member 110. Accordingly, the amount of waste toner conveyed by the first conveying member 120 is greater than the amount moving into the first conveying member 120 from the first conveying section 103A.

The extension part 124 has a bottom surface 124C forming the bottom of the extension part 124, and the body part 121 has a bottom surface 121D forming the bottom of the body part 121, as shown in FIG. 3. The extension part 124 slopes upward in the extended direction, i.e., frontward direction of the body part 121. Put another way, the bottom surface 124C slopes upward toward the frontward direction, in which the bottom surface 121D extends. More specifically, the extension part 124 is configured such that a gap is formed between the bottom surface 124C and the bottom wall 101D when the front edge on the bottom surface 121D of the body part 121 is in its lowest position. Thus, the extension part 124 is configured so that the bottom surface 124C does not contact the bottom wall 101D when the first conveying member 120 rotates.

The extension part 124 is arranged in a position so that its front edge does not contact the connecting part B2 when the first conveying member 120 rotates. In other words, the extension part 124 is arranged so that its path of rotated movement does not overlap the connecting part B2 when viewed in the front-rear direction. Thus, the connecting part B2 does not interfere with the rotation of the first conveying member 120.

Next, the operations of the first conveying member 120 having the above configuration will be described with reference to FIGS. 6A-6D.

Figure 6A:
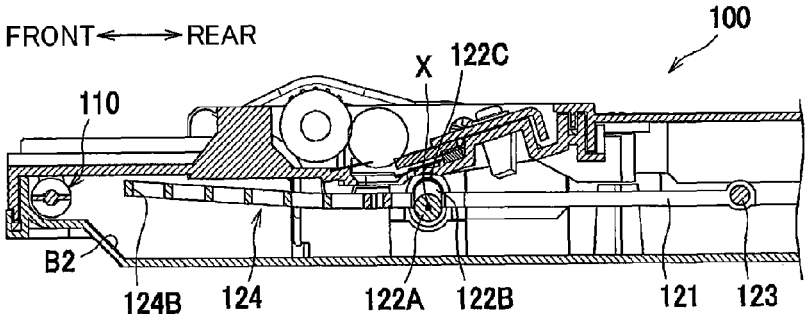
FIG. 6A is a view for description of an operation of a first conveying member and showing a posture of a main housing.
Figure 6B:
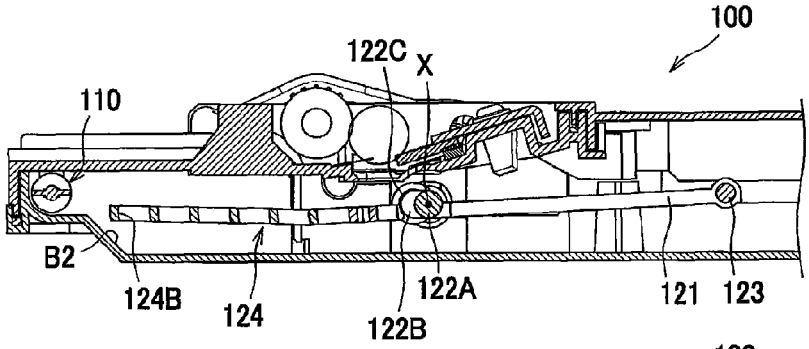
FIG. 6B is a view for description of the operation of the first conveying member and showing another posture of the main housing.
Figure 6C:
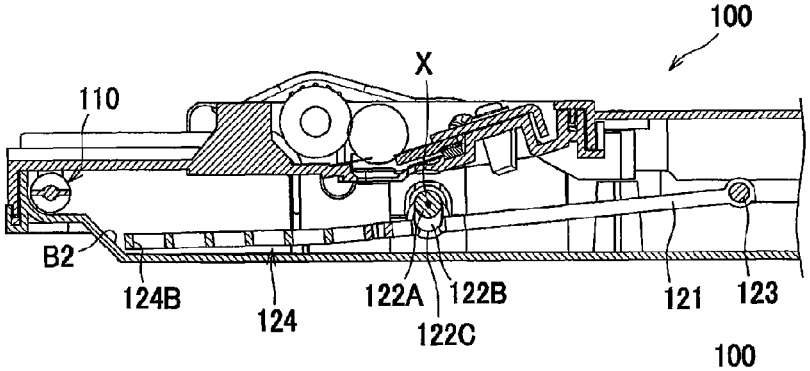
FIG. 6C is a view for description of the operation of the first conveying member and showing still another posture of the main housing.
Figure 6D:
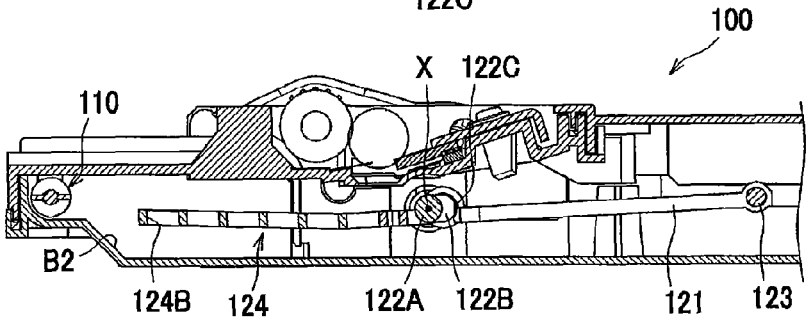
FIG. 6D is a view for description of the operation of the first conveying member and showing still another posture of the main housing.

When the rotational shaft parts 122A rotate counterclockwise in FIG. 6 from the state shown in FIG. 6D, the support part 122C revolves counterclockwise in FIG. 6 about the central axis X, as shown in FIG. 6A, and moves to a position obliquely above and forward of the position in FIG. 6D. Consequently, the body part 121 and support parts 123 move forward and the body part 121 rotates upward about the support parts 123 so that the front end of the body part 121 moves obliquely upward and forward.

When the support part 122C moves to a position diagonally downward and forward from the position shown in FIG. 6A, the body part 121 and support parts 123 move farther forward, as shown in FIG. 6B. At this time, the body part 121 rotates downward about the support parts 123 so that the front end of the body part 121 moves obliquely downward and forward.

As the support part 122C moves to a position diagonally downward and rearward from the position shown in FIG. 6B, the body part 121 and support parts 123 move rearward, as shown in FIG. 6C. At this time, the body part 121 rotates further downward about the support parts 123 so that the front end of the body part 121 moves obliquely downward and rearward.

As the support part 122C moves to a position obliquely upward and rearward from the position in FIG. 6C, the body part 121 and support parts 123 move farther rearward, as shown in FIG. 6D. At this time, the body part 121 rotates upward about the support parts 123 so that the front end of the body part 121 moves obliquely upward and rearward.

As described above, by moving the body part 121 forward and rearward while the body part 121 pivots about the support parts 123, the extension part 124 moves obliquely upward and forward from the position in FIG. 6D, then moves obliquely downward and forward, and then moves obliquely downward and rearward, as illustrated in FIGS. 6A-6D. Thus, when approaching the first conveying section 103A, the extension part 124 first moves upward, and then moves downward. While moving downward, the extension part 124 begins to separate from the first conveying section 103A.

Hence, the first conveying member 120 rotates up and down while the second conveying surfaces 124B and first conveying surfaces 121C scrape up waste toner, and the further forward from the rotational shaft part 122A, the greater the up-down movement of the first conveying member 120. In this way, the first conveying member 120 can convey the waste toner rearward.

As shown in FIG. 4, the auger 130 is disposed inside the second toner conveying portion 106. The auger 130 has a rotational shaft 131 oriented in the left-right direction, and a spiral-shaped conveying blade 132 provided around the circumference of the rotational shaft 131. When the auger 130 rotates, waste toner is carried on the conveying blade 132 and conveyed from left to right.

The amount of waste toner that the conveying blade 132 of the auger 130 conveys is greater than the amount conveyed by the second conveying member 110. Accordingly, the auger 130 conveys a greater amount of waste toner than the amount conveyed toward the accommodating section 102.

The rotational shaft 131 extends from the left wall 101G of the second toner conveying portion 106 to a position near the left wall 103C of the second conveying section 103B. A second gear 130A as an example of the gear in the invention is provided on the left side of the frame 101, and specifically on a side surface 101H of the frame 101 opposite the side of the first toner conveying portion 103. A third gear 130B is provided on the left side of the left wall 103C constituting the second conveying section 103B. The left end of the rotational shaft 131 is coupled with the second gear 130A, while the right end of the rotational shaft 131 is coupled with the third gear 130B. A fourth gear 110A disposed on the front side of the third gear 130B is coupled to the left end of the rotational shaft 111.

A drive force from the motor M is transmitted to the second gear 130A through a gear train (not shown). Hence, the second gear 130A transmits the drive force to the auger 130.

The third gear 130B is coupled to the fourth gear 110A via a gear train (not shown). With this configuration, the auger 130 can transmit a drive force from the second gear 130A to the second conveying member 110 via the third gear 130B and the fourth gear 110A. In other words, the second gear 130A functions to transmit a drive force to the second conveying member 110.

Similarly, the second gear 130A is connected via a gear train (not shown) to a cleaning roller gear (not shown) coupled to the cleaning roller 100A in order to transmit a drive force from the cleaning roller gear.

Next, the operations of the cleaning unit 100 having the above structure will be described.

As shown in FIG. 1, waste toner deposited on the conveying belt 73 after an image-forming operation is moved to a position confronting the cleaning unit 100 by the circulating conveying belt 73 and recovered on the cleaning roller 100A. In the meantime, waste toner deposited on the photosensitive drums 61 is recovered by corresponding cleaning blades and collected in the photosensitive-drum toner conveying section 61A.

As shown in FIG. 3, waste toner collected on the cleaning roller 100A is moved to a position confronting the recovery roller 100B by the rotating cleaning roller 100A and collected by the recovery roller 100B. Waste toner collected on the recovery roller 100B is subsequently moved to a position confronting the blade 100C by the rotating recovery roller 100B, scraped off the recovery roller 100B by the blade 100C, and collected in the accommodating section 102 via the opening 101B.

As shown in FIG. 5A, waste toner collected in the photosensitive-drum toner conveying section 61A is conveyed forward by the auger 61B and enters the guiding section 104 via the collection opening 104A. Since the collection opening 104A is formed with a wide front-rear dimension, leakage of waste toner around the periphery of the collection opening 104A is suppressed, even when the auger 61B conveys a large amount of waste toner.

As illustrated in FIG. 5B, waste toner entering the guiding section 104 falls through the guiding section 104 by its own weight and enters the first conveying section 103A. Since the lower part 104C of the guiding section 104 expands toward the bottom, waste toner is unlikely to clog the entrance to the first conveying section 103A, even when a large amount of waste toner enters the guiding section 104.

Since the waste toner is collected in the right end of the first conveying section 103A connected to the guiding section 104, it is necessary to convey this waste toner leftward through the first conveying section 103A. Here, vibrations or the like can be used to convey waste toner from the right end of the first conveying section 103A toward the left. However, vibrations may lead to operation failures in parts related to the cleaning roller 100A. As an example of such operation failures, gear meshing may degrade and lead to a failure in properly transmitting the drive force from the motor M, and contact may become unstable between the cleaning roller 100A and the surface of the conveying belt 73, resulting in uneven cleaning.

In the preferred embodiment, waste toner that enters the first conveying section 103A is conveyed through the first conveying section 103A from right to left by the first conveying blade 112 of the second conveying member 110, as illustrated in FIG. 4. Thus, waste toner collected from the photosensitive drums 61 can be conveyed leftward without generating vibrations in the region of the cleaning roller 100A.

Waste toner conveyed to the left end of the first conveying section 103A is subsequently pushed toward the second conveying section 103B by the second conveying blades 113. Since the second conveying blades 113 are connected to the left edge of the first conveying blade 112, waste toner carried on the first conveying blade 112 can be quickly transferred to the second conveying blades 113 and smoothly conveyed to the second conveying section 103B.

Further, the inner surface of the bottom portion B1 constituting the second conveying section 103B is positioned lower than the inner surface on the bottom portion A1 of the first conveying section 103A, as illustrated in FIG. 3. Therefore, waste toner moves smoothly by its own weight into the second conveying section 103B.

The second conveying section 103B connected to the accommodating section 102 has a smaller left-right dimension than the accommodating section 102. With this configuration, there is some risk that the waste toner in the second conveying section 103B could not be conveyed to the accommodating section 102 if the conveying member only had the body part provided in the accommodating section 102.

On the contrary, in the preferred embodiment, the conveying member has the extension part 124. Waste toner conveyed into the second conveying section 103B is scraped up by the second conveying surfaces 124B of the extension part 124 provided in the second conveying section 103B and is conveyed toward the accommodating section 102. In this way, waste toner collected from the photosensitive drums 61 can be conveyed to the accommodating section 102.

Waste toner collected in the accommodating section 102 is subsequently scraped up by the first conveying surfaces 121C of the body part 121 and is conveyed rearward. Since the waste toner is conveyed toward the rear of the accommodating section 102 in this way, waste toner can be accumulated sequentially from the rear side of the accommodating section 102, thereby effectively utilizing the space in the accommodating section 102.

As waste toner is accumulated in the accommodating section 102, some waste toner overflows from the accommodating section 102 and enters the second toner conveying portion 106 through the communication part 106A. Waste toner entering the second toner conveying portion 106 is conveyed from left to right by the auger 130 and enters the detecting section 105. Waste toner collecting in the detecting section 105 subsequently blocks light emitted by the photosensor (not shown), enabling the photosensor to detect when the accommodating section 102 is full.

The following operational advantages can be obtained from the embodiment described above.

Waste toner collected from the cleaning roller 100A and waste toner collected in the first toner conveying portion 103 is conveyed to the front side of the accommodating section 102. Since the first conveying member 120 conveys waste toner collected in the front side of the accommodating section 102 toward the rear side of the same, the space in the rear side of the accommodating section 102 can be effectively utilized.

Since the first conveying member 120 conveys waste toner rearward, i.e., to the opposite side from the detecting section 105, waste toner is unlikely to enter the detecting section 105 until the accommodating section 102 overflows with waste toner. Accordingly, the color laser printer 1 is unlikely to mistakenly detect that the accommodating section 102 is full when it is not.

Owing to the partitioning wall 101E, the left wall 103C of the second conveying section 103B, and the plurality of walls disposed on the left side of the left wall 103C, waste toner in the accommodating section 102 and first toner conveying portion 103 is unlikely to migrate into the detecting section 105. Accordingly, waste toner can be sufficiently accumulated in the accommodating section 102.

Since the communication part 106A, through which waste toner enters the second toner conveying portion 106 when overflowing from the accommodating section 102, is separated from the second conveying section 103B, waste toner just recovered in the accommodating section 102 from the second conveying section 103B is unlikely to enter the detecting section 105.

The auger 130 can convey waste toner from the accommodating section 102 to the detecting section 105.

Thus, if the amount of waste toner entering the accommodating section 102 is larger than the amount of waste toner entering the detecting section 105, waste toner is likely to cause blockage in the region of the communication part 106A. However, since the quantity of waste toner conveyed by the auger 130 is greater than the quantity of waste toner conveyed toward the accommodating section 102 in the preferred embodiment, the configuration of the embodiment prevents waste toner from clogging up the communication part 106A.

Since the auger 130 can be used to transmit a drive force to the second conveying member 110, both the auger 130 and the second conveying member 110 can be driven by a single motor M, thereby reducing the number of required parts.

As shown in FIG. 4, the auger 130 is adjacent to the second conveying section 103B. If the second gear 130A were provided on the first toner conveying portion 103 side, it would be necessary to set the positions of the auger 130 and the second gear 130A higher than the second conveying section 103B to prevent the auger 130 from penetrating the second conveying section 103B. Consequently, the cleaning unit 100 would need to be larger in the vertical dimension. However, since the second gear 130A is provided on the opposite side from the first toner conveying portion 103 in the embodiment, there is no need to position the auger 130 and second gear 130A above the second conveying section 103B, thereby reducing the size of the cleaning unit 100 and facilitating its construction.

Japanese Patent Application Publication No. 2002-6574 discloses an image forming apparatus including a photosensitive member, a belt whose upper surface is in contact with the photosensitive member, and a waste toner container positioned below the belt and configured to accommodate waste toner collected from the photosensitive body. Waste tonner collected from the photosensitive member is conveyed at a position outside of the belt, and is collected at one end portion of the waste toner container in leftward/rightward direction thereof. The collected waste toner is then fed toward another end portion of the waste toner container by vibration imparted by a vibratory source.

Assuming that the above-described structure disclosed in Japanese Patent Application Publication No. 2002-6574 is applied to a waste toner container of a belt cleaning unit provided with a cleaning member. In the latter case, operation failure may occur at the cleaning member due to vibration.

Another object of the present disclosure is to provide a cleaning unit capable of conveying waste toner in a direction from an outside of the belt to an inside of the belt, yet capable of eliminating or restraining operation failure of the cleaning member due to vibration.

According to one aspect, there is provided a cleaning unit including a first accommodating chamber, a conveyer, and a conveyer. The cleaning unit is configured to accommodate therein developing agent. The cleaner is configured to collect developing agent from a belt in contact with a photosensitive member. The conveyer has one end positioned outward of the belt in a widthwise direction of the belt and another end positioned inward of the belt in the widthwise direction. The conveyer is configured to convey developing agent that has been collected from a component other than the belt toward the first accommodating chamber. The conveyer is rotatable in the conveyer for conveying the developing agent collected from the component other than the belt from a position outward of the belt to a position inward of the belt.

The second conveying member 110 described above can convey waste toner collected from the photosensitive drums 61 from outside the right edge 73B of the conveying belt 73 to inside the same. Therefore, the second conveying member 110 can suppress operation failures in the cleaning roller 100A.

The second conveying blades 113 can convey waste toner into the first conveying section 103A by pushing the waste toner. Accordingly, compared to a structure whose conveying member does not have second conveying blades, the second conveying blades 113 can easily convey a large amount of waste toner toward the second conveying section 103B. Further, the second conveying blades 113 can smoothly convey waste toner received in the first conveying section 103A toward the second conveying section 103B.

Since the second conveying blades 113 are connected to the left end of the first conveying blade 112, the first conveying blade 112 can quickly transfer waste toner to the second conveying blades 113. Accordingly, the second conveying blades 113 can push a larger amount of waste toner than a structure whose second conveying blades are not connected to the left end of the first conveying blade. Further, the second conveying blades 113 can more smoothly convey waste toner toward the second conveying section 103B The inner surface on the bottom portion B1 of the second conveying section 103B is positioned lower than the inner surface on the bottom portion A1 of the first conveying section 103A. Hence, waste toner can move easily by its own weight from the first conveying section 103A to the second conveying section 103B.

The further forward from the rotational shaft part 122A, the larger the first conveying member 120 moves vertically. Therefore, the extension part 124 can easily scrape up waste toner accumulating in the front end of the second conveying section 103B.

Since the connecting part B2 does not interfere with the extension part 124, the first conveying member 120 can rotate smoothly.

The extension part 124 can convey a larger amount of waste toner than the amount of waste toner transferred from the first conveying section 103A, reducing the likelihood of waste toner blocking up the second conveying section 103B.

The sealing member 114 can suppress leakage of waste toner conveyed to the internal left-right end of the first conveying section 103A.

Japanese Patent Application Publication No. 2009-210650 discloses a waste toner accommodation unit including a waste toner accommodating portion and a conveying member for conveying waste toner in the waste toner accommodating portion from one side to another side in frontward/rearward direction thereof.

Assuming that a waster toner conveying portion for conveying waste toner to the waste toner accommodating portion is provided to the waste toner accommodation unit disclosed in Japanese Patent Application Publication No. 2009-210650. In the latter case, if the waste toner conveying portion has a width smaller than that of the waste toner accommodating portion, the conveying member in the waste toner accommodating portion may not be able to convey waste toner in the waste toner conveying portion toward the waste toner accommodating portion.

Still another object of the present disclosure is to provide a cleaning unit and an image forming apparatus provided with the same capable of conveying waste toner in the waste toner conveying portion toward the waste toner accommodating portion in spite of the provision of the waste conveying portion having a width smaller than that of the waste toner accommodating portion.

According to another aspect, there is provided a cleaning unit including a first accommodating chamber, a first conveyer, and a transporting member. The first accommodating chamber is configured to accommodate therein developing agent. The first accommodating chamber has one end portion and another end portion. The first conveyer is configured to convey the developing agent from the one end portion toward the another end portion. The first developing agent conveyer includes a carrying section connected to the one end portion of the first accommodating chamber. The carrying section has a collection hole and has a length in a first direction extending perpendicular to a direction from the one end portion to the another end portion of the first accommodating chamber and perpendicular to a vertical direction. The length of the carrying section is smaller than a length of the first accommodating chamber in the first direction. The transporting member has a portion positioned in the carrying section and is configured to convey the developing agent from the carrying section to the first accommodating chamber.

The extension part 124 of the first conveying member 120 is disposed inside the second conveying section 103B, which is connected to the accommodating section 102 but has a smaller width than the accommodating section 102. Accordingly, the extension part 124 can convey waste toner from the second conveying section 103B toward the accommodating section 102.

Since the extension part 124 is integrally formed with the body part 121 a separate motor need not be provided for the extension part, unlike a structure in which the extension part and body part are separate members, thereby reducing the number of required parts.

The first conveying member 120 rotates up and down greater the farther forward from the rotational shaft part 122A. In other words, the distal end of the extension part 124 moves across a greater vertical range than its proximal end. Accordingly, the extension part 124 can easily scrape up waste toner that has accumulated in the front end of the second conveying section 103B.

Since the extension part 124 slopes upward toward the front relative to the body part 121, the bottom portion B1 of the second conveying section 103B does not interfere with the bottom surface 124C of the extension part 124.

By providing the first toner conveying portion 103 on the same side as the handle 101C (the front side in this case), waste toner can be restrained from spilling out of the first toner conveying portion 103 when the user picks up the cleaning unit 100 by the handle 101C, unlike a structure in which the first toner conveying portion is arranged on the rear side.

Since the first toner conveying portion 103 is disposed adjacent to the right side of the handle 101C, the space on the right side of the handle 101C is effectively utilized and, hence, the cleaning unit 100 can be made more compact.

The first toner conveying portion 103 protrudes farther rightward than the accommodating section 102. Hence, even when parts are disposed in the space within the main casing 2 to the right of the accommodating section 102, i.e., in the space on the rear of the first toner conveying portion 103, such parts will not interfere with the first toner conveying portion 103 when the cleaning unit 100 is mounted in or removed from the main casing 2 via the access opening 21A. Accordingly, space in the main casing 2 to the rear of the first toner conveying portion 103 can be effectively utilized.

Japanese Patent Application Publication No. 2001-66894 discloses an image forming apparatus including a photosensitive member, a toner accommodating portion for accommodating toner collected from the photosensitive member, and a toner conveying portion connected to the toner accommodating portion. The toner conveying portion has a collection opening, a first portion extending downward from the collection opening, and a second portion connected to the toner accommodating portion and extending in leftward/rightward direction from a lower end of the first portion. The first portion and the second portion are tubular in shape having inner diameters generally equal to each other. Conveyer coils are provided in the first and second portions for conveying the toner.

According to the image forming apparatus described in Japanese Patent Application Publication No. 2001-66894. Toner entered into the first portion through the collection opening may be clogged at a connecting portion between the first portion and the second portion, since the inner diameter of the first and second portions are generally equal to each other.

Still another object of the present disclosure is to provide a cleaning unit and an image forming apparatus provided with the same capable of restraining clogging of toner in the toner conveying portion, particularly at a portion causing a change in toner conveying direction.

According to another aspect, there is provided a cleaning unit including a first accommodating chamber, a first developing agent conveyer, and a guide portion. The first accommodating chamber is configured to accommodate therein developing agent. The first developing agent conveyer includes a first conveying section configured to convey the developing agent to the first accommodating chamber. The first conveying section has an end portion. The guide portion extends upward from the end portion of the first conveying section. The guide portion has an upper end formed with a collection opening and a lower end connected to the end portion of the first conveying section. The guide portion is configured to guide the developing agent that has been passed through the collection opening toward the first conveying section. The guide portion has a lower portion whose open area is gradually increased toward the lower end.

Since the lower part 104C of the guiding section 104 grows wider toward the bottom, the guiding section 104 can reduce blockage in the right end portion of the first conveying section 103A from waste toner passing through the guiding section 104.

Since the guiding section 104 grows wider in the front-rear direction toward the top, the collection opening 104A can be formed wider in the front-rear direction. Further, the lower part 104C of the guiding section 104 expands toward the bottom, thereby reducing the likelihood of waste toner blocking up the right end of the first conveying section 103A, even when a large quantity of waste toner is collected through the collection opening 104A.

By forming the collection opening 104A with a wide front-rear dimension, waste toner is less likely to clog the area around the photosensitive-drum toner conveying section 61A and collection opening 104A, even when a large amount of waste toner is conveyed thereto.

However, in a structure that provides the collection opening 104A in a position near the right end of the first conveying section 103A, waste toner has a tendency to leak through the connecting area between the guiding section 104 and the area on the photosensitive drum 61 in which waste toner is conveyed toward the guiding section 104 when waste toner accumulates in this right end of the first conveying section 103A. However, since the guiding section 104 in the embodiment is configured such that the collection opening 104A is at a higher position than the cleaning roller 100A, waste toner accumulating in the right end of the first conveying section 103A is unlikely to reach this connecting area, thereby reducing the likelihood of waste toner leaking through in connecting area.

Further, the collection opening 104A is positioned lower than the upper portion on the outer surface 73A of the conveying belt 73. This arrangement restrains waste toner from scattering on the upper portion of the outer surface 73A on the conveying belt 73, even when waste toner collected from the photosensitive drums 61 leaks through the connecting area between the guiding section 104 and photosensitive-drum toner conveying section 61A. Hence, this arrangement can also reduce the effects of scattering waste toner on image quality.

While the description has been made in detail with reference to specific embodiment thereof, it would be apparent to those skilled in the art that various changes and modifications may be made therein without departing from the spirit and scope of the above described embodiment.

Figure 7A:
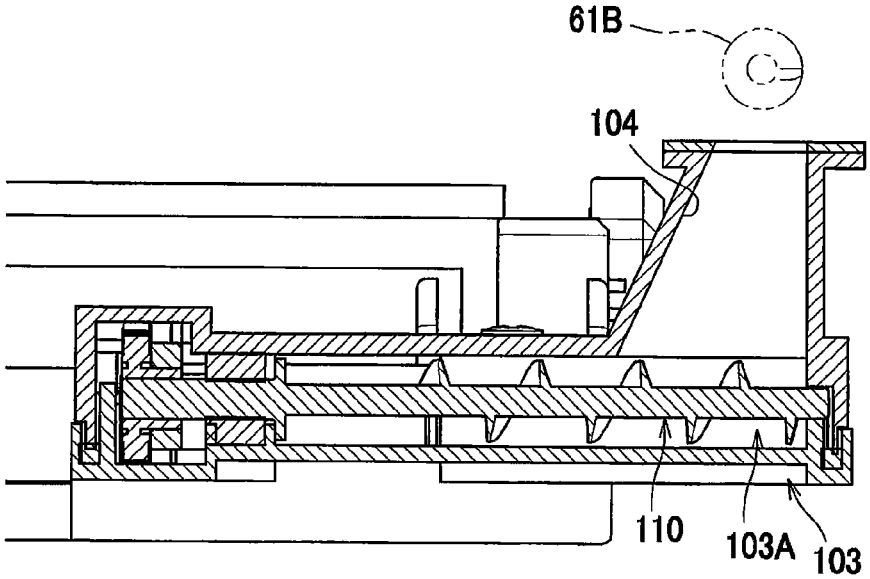
FIG. 7A is a cross-sectional view showing a guiding section according to a first modification.

In the embodiment described above, the lower part 104C of the guiding section 104 extends downward while expanding in the left-right direction. However, the entire guiding section 104 may be configured to expand in the left-right direction from the top end to the bottom end thereof, as shown in FIG. 7A as a first modification.

Figure 7B:
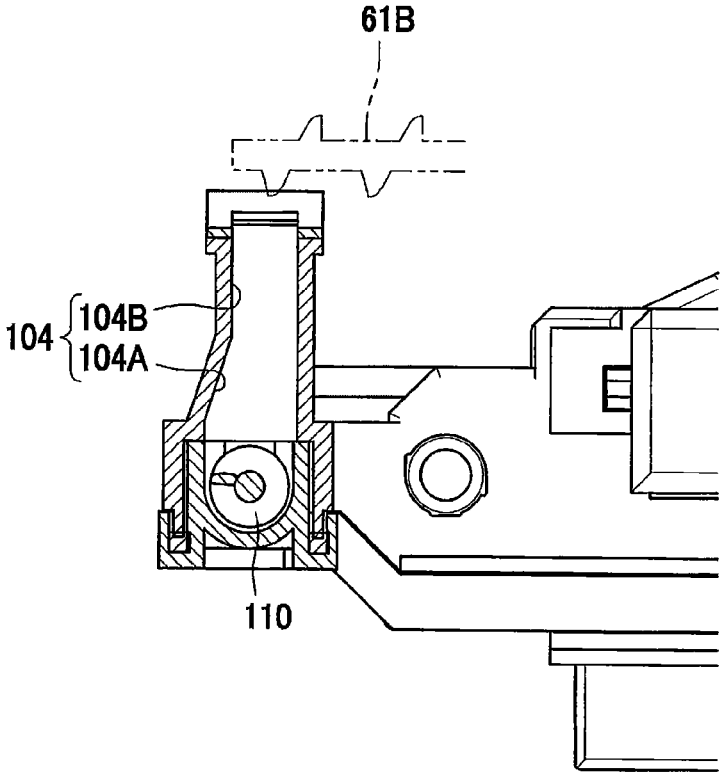
FIG. 7B is a cross-sectional view showing a guiding section according to a second modification.

Alternatively, the guiding section 104 may be configured such that at least the lower part 104C expands in the front-rear direction from top to bottom, as shown in FIG. 7B according to a second modification.

Figure 8A:
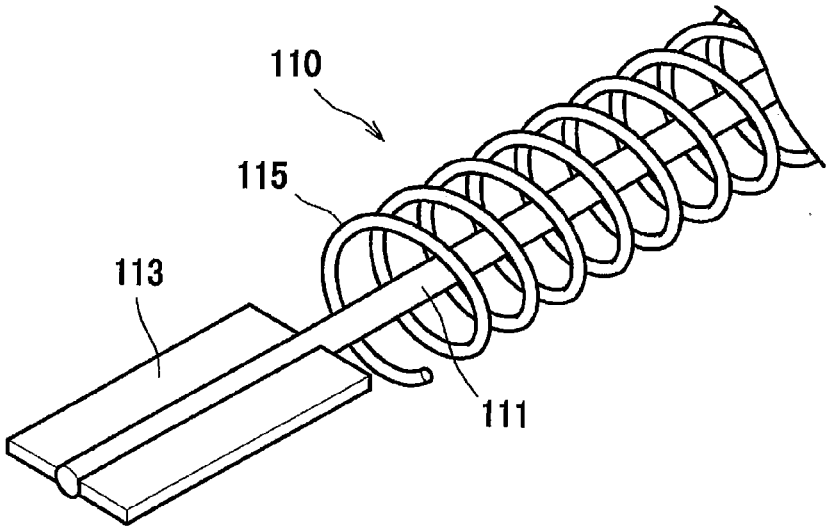
FIG. 8A is a perspective view of a second conveying member according to a third modification.
Figure 8B:
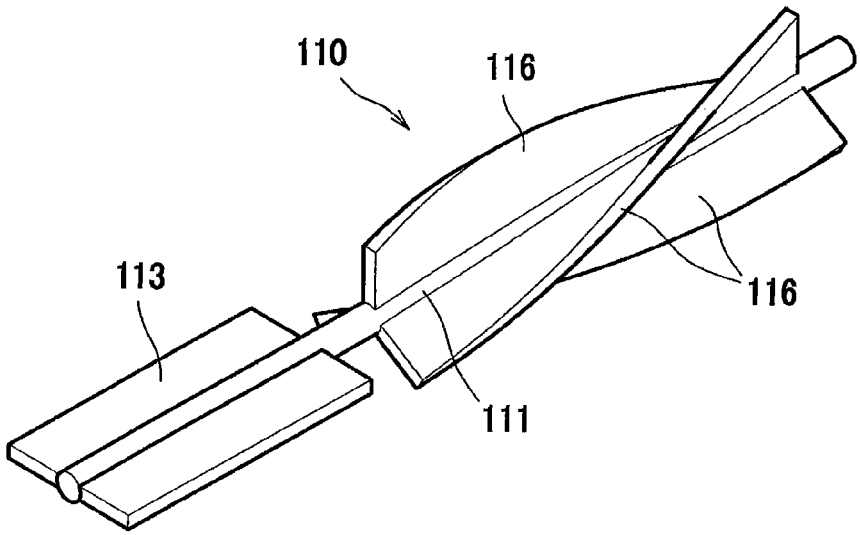
FIG. 8B is a perspective view of a second conveying member according to a fourth modification.

In the embodiment described above, the first conveying blade 112 is wound about the circumference of the rotational shaft 111, but the present invention is not limited to this configuration. For example, a first conveying blade 115 according to a third modification shown in FIG. 8A may be provided around the periphery of the rotational shaft 111. The first conveying blade 115 is configured of a wire. Alternatively, a plurality of first conveying blades 116 according to a fourth modification may be wound around the circumference of the rotational shaft 111, as illustrated in FIG. 8B.

In the embodiment described above, the first toner conveying portion 103 is configured to convey waste toner collected from the photosensitive drums 61, but the present invention is not limited to this configuration. That is, the first toner conveying portion 103 may be configured to convey waste toner collected from members other than the conveying belt 73 and the photosensitive drums 61.

In the embodiment described above, the first toner conveying portion 103 is connected to the front side of the accommodating section 102. However, the first toner conveying portion 103 may be connected to the right side surface 102A or the left side surface of the accommodating section 102 at a position forward of the cleaning roller 100A, for example.

In the embodiment described above, the inner surface on the bottom portion B1 of the second conveying section 103B is positioned lower than the inner surface on the bottom portion A1 of the first conveying section 103A, but the inner surfaces of the bottom portion B1 and bottom portion A1 may be positioned at the same height instead.

In the embodiment described above, the extension part 124 is capable of conveying a larger amount of waste toner than the second conveying member 110, but these components may be capable of conveying the same amount of waste toner, for example.

In the embodiment described above, the auger 130 is capable of conveying a larger quantity of waste toner than the second conveying member 110, but these components may be capable of conveying the same amount of waste toner, for example.

In the embodiment described above, the auger 130 is configured to transmit a drive force to the second conveying member 110. However, a drive force may be transmitted to the second conveying member 110 through a separate member from the auger 130.

While the body part 121 and extension part 124 are formed integrally in the embodiment, these components may be configured of separate members. In this case, the drive force transmitted to the member corresponding to the body part and the drive force transmitted to the member corresponding to the extension part preferably originate from the same drive source. With this configuration, the operations of the body part and extension part can be more easily synchronized.

While the extension part 124 slopes upward toward the front relative to the body part 121 in the embodiment described above, the present invention is not limited to this configuration.

In the embodiment described above, the detecting section 105 is formed as a recess that extends downward from the bottom wall 101D. However, the detecting section 105 may be formed to protrude forward from the front wall of the frame 101, for example.

While the present invention is applied to the color laser printer 1 in the preferred embodiment, the present invention may be applied to another image-forming device, such as a copy machine or a multifunction peripheral.

What is claimed is:

1. A cleaning unit comprising:

a first accommodating chamber configured to accommodate developing agent therein, the first accommodating chamber having one end portion and another end portion;

a first conveyer configured to convey the developing agent from the one end portion toward the another end portion, the first conveyer being positioned in the first accommodating chamber;

a cleaner configured to clean the developing agent from a belt in contact with a photosensitive member; and a first developing agent conveying portion, different from the first conveyer, being configured to convey the developing agent from a collection opening toward the first accommodating chamber, the collection opening configured to collect therethrough the developing agent collected from a component other than the belt, the cleaner and the first developing agent conveying portion being positioned at the one end portion, the first developing agent conveying portion and the cleaner being connected to the first accommodating chamber at different portions of the first accommodating chamber.

2. The cleaning unit as claimed in claim 1, wherein the first developing agent conveying portion is connected to the first accommodating chamber at a position closer to the one end portion than the cleaner is to the one end portion.

3. The cleaning unit as claimed in claim 2, further comprising:

a frame defining therein the first accommodating chamber and the first developing agent conveying portion, the frame defining the one end portion; and a second accommodating chamber positioned at the one end portion of the frame configured to accommodate therein the developing agent overflowed from the first accommodating chamber.

4. The cleaning unit as claimed in claim 3, further comprises a wall configured to partition the second accommodating chamber from the first accommodating chamber and the first developing agent conveying portion.

5. The cleaning unit as claimed in claim 4, wherein the frame has one widthwise end portion and another widthwise end portion in a widthwise direction of the belt, the frame also having a side wall at the another widthwise end portion, the first developing agent conveying portion being disposed at the one widthwise end portion; and wherein the wall extends toward the another widthwise end portion beyond the second accommodating chamber in the widthwise direction, the wall having an end in the widthwise direction spaced away from the side wall.

6. The cleaning unit as claimed in claim 5, further comprising:

a second developing agent conveying portion provided between the wall and the frame, the second developing agent conveying portion being configured to allow the developing agent to be conveyed therethrough from the first accommodating chamber to the second accommodating chamber; and an auger provided at the second developing agent conveying portion and configured to convey the developing agent from the first accommodating chamber toward the second accommodating chamber.

7. The cleaning unit as claimed in claim 6, further comprising a second conveyer configured to convey the developing agent that has been passed through the collection opening from the first developing agent conveying portion toward the first accommodating chamber, the auger providing a developing agent conveying performance greater than that of the second conveyer.

8. The cleaning unit as claimed in claim 7, further comprising a gear positioned opposite to the first developing agent conveying portion in the widthwise direction.

9. The cleaning unit as claimed in claim 8, wherein the gear is configured to transmit a driving force to the auger and the second conveyer.

10. The cleaning unit as claimed in claim 9, wherein the auger is configured to transmit the driving force from the gear to the second conveyer.

11. The cleaning unit as claimed in claim 8, wherein the cleaner comprises a cleaning roller, the gear being configured to transmit a driving force to the cleaning roller.

12. The cleaning unit as claimed in claim 1, further comprising a frame defining therein the first accommodating chamber and the first developing agent conveying portion, the frame having a side portion to which the developing agent conveying portion being connected.

13. A cleaning unit comprising:

a first accommodating chamber configured to accommodate therein developing agent, the first accommodating chamber having one end portion and another end portion;

a first conveyer configured to convey the developing agent from the one end portion toward the another end portion, the first conveyer being positioned in the first accommodating chamber;

a cleaner configured to clean the developing agent from a belt in contact with a photosensitive member, the cleaner being positioned at the one end portion;

a first conveying section connected to the first accommodating chamber and having a collection opening configured to collect therethrough developing agent collected from a component other than the belt, the first conveying section having one end positioned outward of the belt in a widthwise direction of the belt, and another end positioned inward of the belt in the widthwise direction; and a second conveyer rotatable in the first conveying section for conveying the developing agent collected from the component other than the belt from a position outward of the belt to a position inward of the belt.

14. The cleaning unit as claimed in claim 13, wherein the second conveyer comprises a rotation shaft, and a first conveying blade provided spirally over the rotation shaft.

15. A cleaning unit comprising:

a first accommodating chamber configured to accommodate therein developing agent, the first accommodating chamber having one end portion and another end portion;

a first conveyer configured to convey the developing agent from the one end portion toward the another end portion, the first conveyer being positioned in the first accommodating chamber;

a cleaner configured to clean the developing agent from a belt in contact with a photosensitive member;

a first developing agent conveying portion, different from the first conveyer, being configured to convey the developing agent from a collection opening toward the first accommodating chamber, the collection opening configured to collect therethrough the developing agent collected from a component other than the belt, the cleaner and the first developing agent conveying portion being positioned at the one end portion, the first developing agent conveying portion comprising a carrying section connected to the one end portion of the first accommodating chamber, the carrying section having a length in a first direction extending perpendicular to a direction from the one end portion to the another end portion of the first accommodating chamber and to a vertical direction, the length of the carrying section being smaller than a length of the first accommodating chamber in the first direction; and a transporting member having a portion positioned in the carrying section and configured to convey the developing agent from the carrying section to the first accommodating chamber.

16. The cleaning unit as claimed in claim 15, wherein the first conveyer and the transporting member are driven by an identical drive source.

17. A cleaning unit comprising:

a first accommodating chamber configured to accommodate therein developing agent, the first accommodating chamber having one end portion and another end portion;

a first conveyer configured to convey the developing agent from the one end portion toward the another end portion, the first conveyer being positioned in the first accommodating chamber;

a cleaner configured to clean the developing agent from a belt in contact with a photosensitive member;

a first developing agent conveying portion, different from the first conveyer, being configured to convey the developing agent from a collection opening toward the first accommodating chamber, the collection opening configured to collect therethrough the developing agent collected from a component other than the belt, the cleaner and the first developing agent conveying portion being positioned at the one end portion, the first developing agent conveying portion comprising a first conveying section configured to convey the developing agent toward the first accommodating chamber, the first conveying section having an end portion; and the cleaning unit further comprising a guide portion extending upward from the end portion of the first conveying section, the guide portion having an upper end formed with the collection opening and a lower end connected to the end portion of the first conveying section, the guide portion being configured to guide the developing agent that has been passed through the collection opening toward the first conveying section, the guide portion having a lower portion whose open area is gradually increased toward the lower end.

18. The cleaning unit as claimed in claim 17, wherein the guide portion has an upper portion whose open area is gradually increased toward the upper end.

* * * * *